US007053828B1

(12) United States Patent
Goodzeit et al.

(10) Patent No.: US 7,053,828 B1
(45) Date of Patent: May 30, 2006

(54) SYSTEMS AND METHODS FOR CORRECTING THERMAL DISTORTION POINTING ERRORS

(75) Inventors: Neil Evan Goodzeit, Princeton, NJ (US); Santosh Ratan, Highland Park, NJ (US); Douglas Vernon McKinnon, Princeton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 13 days.

(21) Appl. No.: 10/763,676

(22) Filed: Jan. 22, 2004

(51) Int. Cl.
*H01Q 3/00* (2006.01)

(52) U.S. Cl. ..... 342/359; 342/77

(58) Field of Classification Search ..... 342/75, 342/77, 359, 428
See application file for complete search history.

(56) References Cited

U.S. PATENT DOCUMENTS 5,587,714 A * 12/1996 Chu et al. ..... 342/354
6,014,372 A * 1/2000 Kent et al. ..... 370/316
6,504,502 B1 * 1/2003 Wu et al. ..... 342/354
6,720,918 B1 * 4/2004 Reckdahl et al. ..... 342/358
6,732,977 B1 * 5/2004 Goodzeit et al. ..... 244/164

* cited by examiner

*Primary Examiner*—Dao L. Phan
(74) *Attorney, Agent, or Firm*—McDermott Will & Emery LLP

(57) ABSTRACT

One embodiment of the present invention relates to a system for correcting spacecraft thermal distortion pointing errors. The system comprises one or more spacecraft sensors located at positions on a spacecraft and which are adapted to measure spacecraft parameters at those positions. The system also includes a spacecraft distortion prediction module, which is adapted to generate expected spacecraft thermal distortion parameter values and expected antenna thermal distortion pointing errors. Further, the system includes a spacecraft parameter processing module adapted to generate measured spacecraft thermal distortion parameter values from the measured spacecraft parameters, and an antenna pointing error calculation module adapted to calculate antenna pointing error correction commands. Finally, the system includes an antenna pointing control module adapted to receive the antenna pointing correction commands and control the adjustment of the antenna pointing using the correction commands.

25 Claims, 4 Drawing Sheets

SYSTEMS AND METHODS FOR CORRECTING THERMAL DISTORTION POINTING ERRORS

BACKGROUND OF THE INVENTION

The present invention relates generally to spacecraft attitude control, and more particularly to systems and methods for correcting spacecraft thermal distortion pointing errors.

FIG. 1 is a drawing of one embodiment of a communications spacecraft 100, having a plurality of communications antennas 102–108 mounted on the east and west sides of the spacecraft and on the earth deck. To perform its mission, the spacecraft must maintain the payload antennas pointing at their earth coverage regions at all times. As one skilled in the art will appreciate, this is accomplished using an attitude control system that senses the spacecraft attitude using attitude sensors, such as earth sensors, sun sensors, star sensors, gyros and the like, and applies control torques using reaction wheels or thrusters to null the attitude errors. Although this approach maintains high accuracy pointing of the attitude sensors (typically located on the spacecraft earth deck), the antenna pointing can suffer due to spacecraft structure distortions caused by temperature variations that occur as the sun orientation with respect to the spacecraft changes throughout the day and seasonally.

The thermal distortions can have a significant impact on the spacecraft design and performance. For example, roughly one-third of a typical 0.15 degree antenna pointing error (0.05 degrees) may be caused by structure thermal distortions. For a spacecraft with a payload power of 10 kW and 2 degree spot beams (1250 km in diameter), the payload power must be increased by roughly 10% (1000 Watts) to provide the added coverage area to make up for the thermal distortion pointing errors. To meet this higher requirement, the spacecraft mass may be increased by abut 70 kg, and the spacecraft cost may increase by roughly $1.6 M. The increased mass also may increase the launch cost by requiring the use of a more capable launch vehicle.

Prior art systems attempt to reduce the thermal distortion pointing errors using purely open-loop means. The thermal distortion pointing errors are estimated on the ground using analysis tools, such as MSC.NASTRAN developed by MSC.Software Corporation, based on the material thermoelastic properties and predicted temperature profiles. The pointing error predictions are used to generate spacecraft attitude steering and antenna gimbal commands that correct for the distortion effects. As is true of any open-loop compensation scheme, the accuracy is highly dependent on the modeling accuracy. Thus, what is needed is a system and method that can correct for thermal distortion pointing errors more accurately.

BRIEF SUMMARY OF THE INVENTION

One embodiment of the present invention comprises a system for correcting spacecraft thermal distortion pointing errors. In accordance with this particular embodiment, the system comprises one or more spacecraft sensors located at positions on a spacecraft and which are adapted to measure spacecraft parameters at those positions. The system also includes a spacecraft distortion prediction module, which is adapted to generate expected spacecraft thermal distortion parameter values and expected antenna thermal distortion pointing errors. Further, the system includes a spacecraft parameter processing module adapted to generate measured spacecraft thermal distortion parameter values from the measured spacecraft parameters, and an antenna pointing error calculation module adapted to calculate antenna pointing error correction commands. Finally, the system includes an antenna pointing control module adapted to receive the antenna pointing correction commands and control the adjustment of the antenna pointing using the correction commands.

In accordance with one embodiment, the antenna pointing error calculation calculates antenna pointing error correction commands by: (a) calculating antenna thermal distortion pointing error correction values using the expected spacecraft thermal distortion parameter values and the measured spacecraft thermal distortion parameter values; (b) calculating final antenna thermal distortion pointing error estimates using the expected antenna thermal distortion pointing errors and the antenna thermal distortion pointing error correction values; and (c) generating the antenna pointing error correction commands using the final antenna thermal distortion pointing error estimates.

In accordance with another embodiment of the invention, the spacecraft distortion prediction module, the spacecraft parameter processing module, the antenna pointing error calculation module, and the antenna pointing control module can be configured as one or more processing modules. Further, in accordance with yet other embodiments of the present invention, the one or more sensors can be selected from the group consisting of strain gage sensors, temperature sensors, or a combination of strain gage sensors and temperature sensors.

In accordance with yet another embodiment of the present invention, the spacecraft distortion prediction module can be adapted to use one or more input parameters, such as sun vector information, solar flux information, and spacecraft panel dissipation information to generate the expected spacecraft thermal distortion parameter values and the expected antenna thermal distortion pointing errors.

In accordance with yet another embodiment of the present invention, the spacecraft antenna can be attached to a gimbal arm. With this embodiment, the antenna pointing control module controls the antenna pointing by controlling the gimbal arm. Alternatively, the antenna can be attached to the spacecraft body. In accordance with this embodiment, the system further includes a spacecraft attitude control system which changes the attitude of the spacecraft in order to change the antenna pointing.

In accordance with yet another embodiment, the present invention relates to a method for correcting spacecraft thermal distortion antenna pointing errors. In accordance with this particular embodiment, the method comprises measuring spacecraft thermal distortion parameters values using one or more spacecraft sensors, calculating estimated antenna thermal distortion pointing errors caused by the spacecraft thermal distortions using the measured spacecraft parameter values, and adjusting the antenna pointing to correct for the estimated antenna pointing errors. In this particular embodiment, the spacecraft parameter values are related to spacecraft thermal distortions.

In accordance with one embodiment of the invention, the one or more spacecraft sensors comprise one or more strain gages, and the measured spacecraft parameter values comprise spacecraft strain values. Alternatively, in accordance with another embodiment, the one or more spacecraft sensors comprise one or more temperatures sensors, and the measured spacecraft parameter values comprise spacecraft temperature values.

In accordance with another embodiment of the invention, adjusting the antenna pointing can comprise adjusting an antenna gimbal arm to which the antenna is attached. Alternatively, adjusting the antenna pointing can comprise adjusting the attitude of the spacecraft. In addition, in one embodiment of the method, the method is performed repetitively at a sampling interval.

In accordance with yet another embodiment of the present invention, the method comprises computing expected spacecraft thermal distortion parameter values, computing expected antenna thermal distortion pointing errors, and using the expected spacecraft thermal distortion parameter values, the measured spacecraft thermal distortion parameter values, and the expected antenna thermal distortion pointing errors to calculate the estimated antenna thermal distortion pointing errors. In accordance with one aspect of this embodiment, the expected spacecraft thermal distortion parameter values and/or the expected antenna thermal distortion pointing errors are generated using one or more input parameters, such as sun vector information, solar flux information, and spacecraft panel dissipation information.

In accordance with yet another embodiment, the present invention comprises a spacecraft which incorporates the systems and methods as described herein.

A more complete understanding of the present invention may be derived by referring to the detailed description of preferred embodiments and claims when considered in connection with the figures.

BRIEF DESCRIPTION OF THE DRAWINGS

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION OF THE INVENTION

The present invention relates generally to spacecraft attitude control systems and methods, and more particularly to systems and methods for correcting spacecraft thermal distortion pointing errors. In contrast to the prior-art systems mentioned above, the present invention uses information from on-board sensors to improve the accuracy of both the distortion pointing error estimates and the antenna pointing.

In accordance with one embodiment of the invention, measurements from on-board strain gages are used to sense local distortions at certain positions on the spacecraft structure. An antenna pointing error prediction and correction system uses the differences between the strain gage measurements and predicted local distortions obtained using a spacecraft distortion model to update the antenna pointing error estimates. Spacecraft pointing and antenna gimbal positions then are changed to null the thermal distortion pointing errors. In accordance with another embodiment of the invention, spacecraft temperature measurements can be used in a similar way as the strain gage measurements to correct the thermal distortion antenna pointing errors. And still in other embodiments of the invention, a combination of strain gage measurements and temperature measurements can be used to correct the thermal distortion pointing errors.

Figure 2:
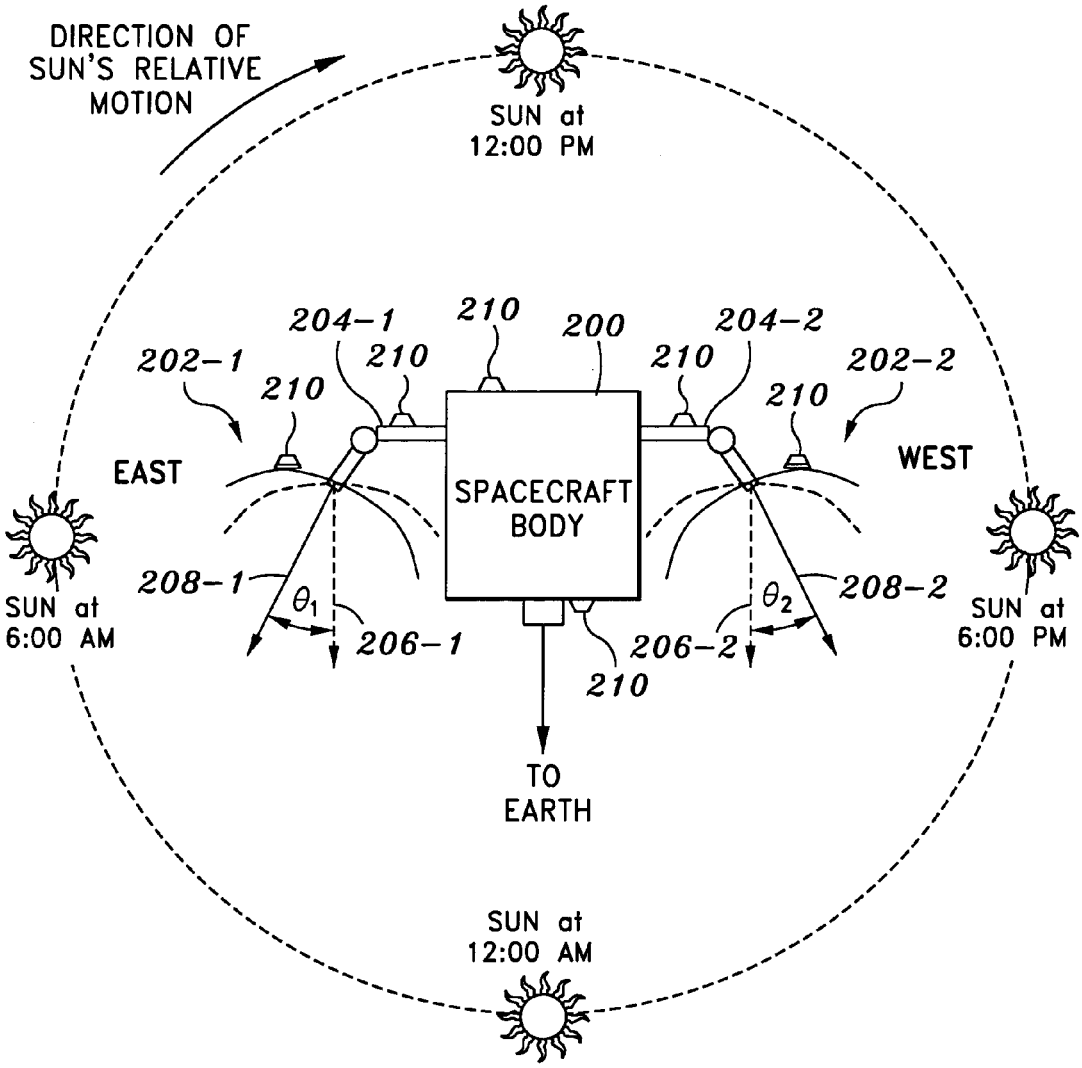
FIG. 2 is schematic drawing showing how thermal distortion can affect spacecraft antenna pointing.

Referring now to FIG. 2, the relationship between the sun and a spacecraft 200 throughout a day is shown. As illustrated, the sun's incident rays and solar flux will affect different portions of spacecraft 200 as the spacecraft rotates about the orbit normal throughout the day. For example, in the simplistic illustration, the sun will irradiate one side of spacecraft 200 at one point in the day (e.g., the east side at 6 am), and the sun will irradiate the other side of spacecraft 200 at another point in the day (e.g., the west side at 6 pm). As one skilled in the art will appreciate, spacecraft body parts will flex and move as the thermal energy incident upon the different portions of the spacecraft changes, which changes the temperature of the different portions of the spacecraft. The flex and movement of the spacecraft body parts can cause the spacecraft antennas to move, creating antenna pointing errors.

Figure 4:
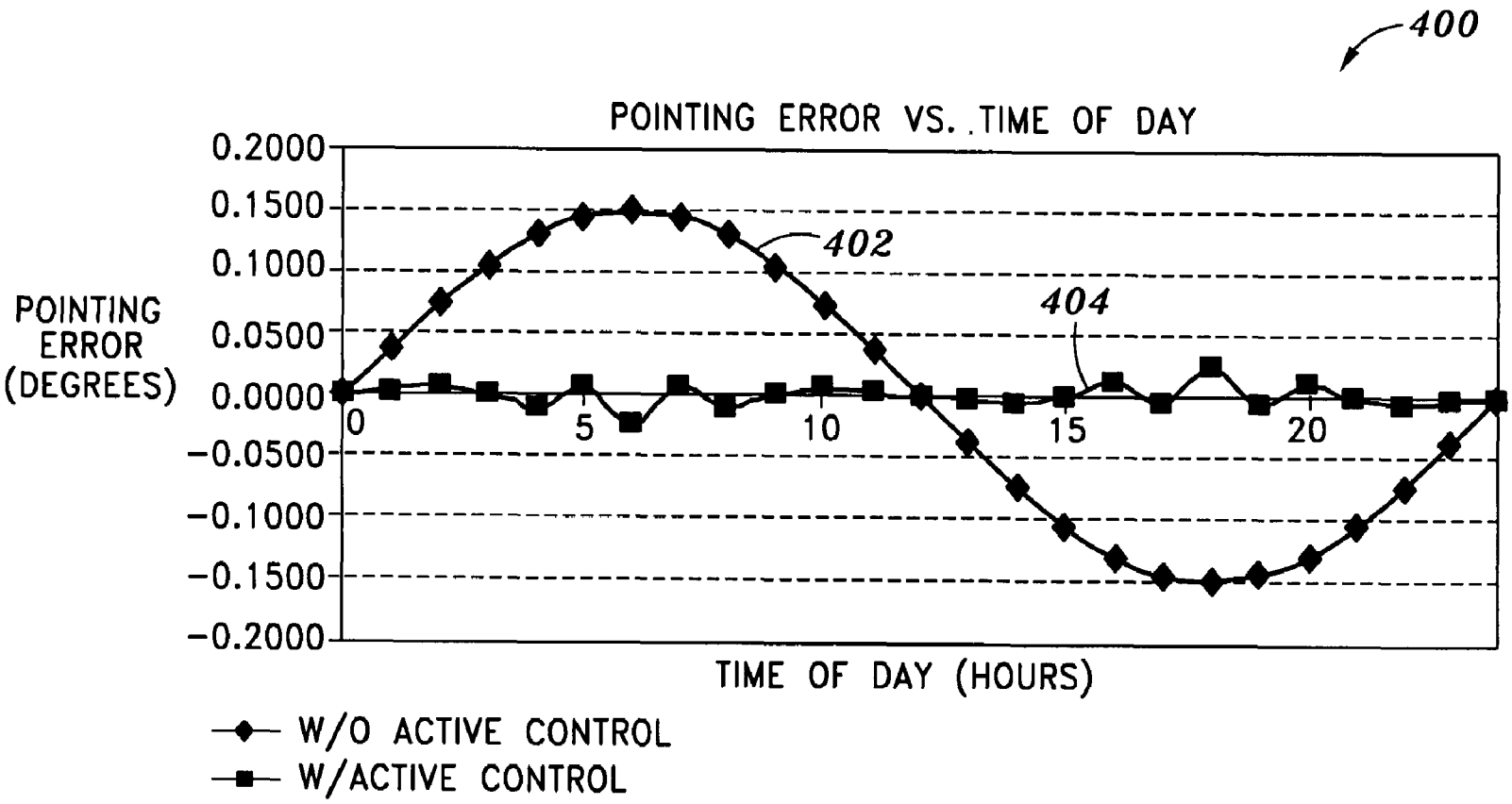
FIG. 4 is a chart illustrating the relationship between antenna pointing errors and time for spacecraft with and without the thermal distortion correction systems of the present invention.

In FIG. 2, spacecraft 200 is configured with antennas 202-1 and 202-2 connected to the spacecraft body with gimbal arms 204-1 and 204-2, respectively. Without the spacecraft thermal distortions, the antennas 202 would be pointing in the direction which optimizes the antenna communications with a selected target; e.g., along antenna axes 206-1 and 206-2. As a result of the thermal distortions, the antenna pointing directions might be altered, for example along antenna axes 208-1 and 208-2 in FIG. 2, which alters the antenna pointing angles by $\theta_1$, and $\theta_2$, respectively, causing pointing errors as discussed. Curve 402 in graph 400 of FIG. 4 illustrates the pointing error angles that can occur over a day period. As one skilled in the art can see, the errors are cyclical because of the relationship of the spacecraft with the sun over the day period.

Figure 1:
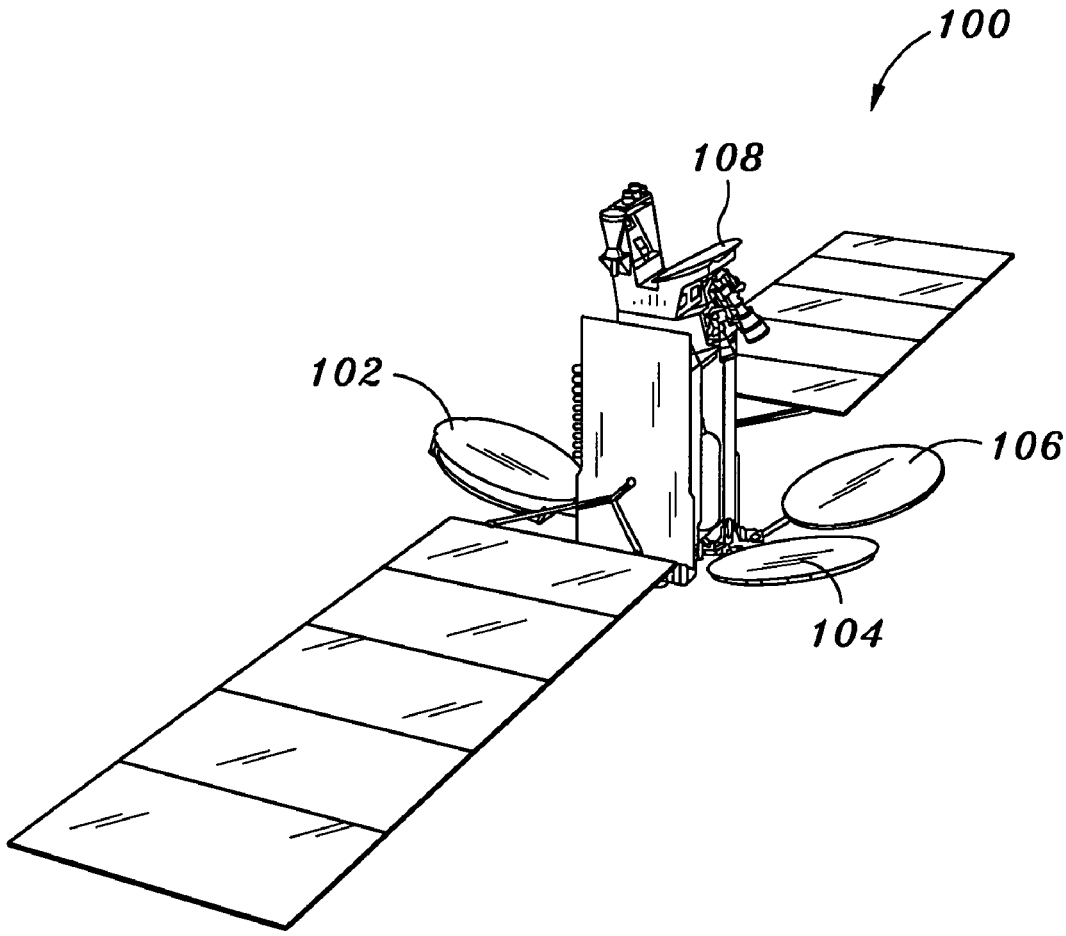
FIG. 1 is a schematic drawing of one embodiment of a spacecraft which includes a number of communication antennas.

The example illustrated in FIG. 2 only shows two antennas, but one skilled in the art will appreciate that any number of antennas can be on the spacecraft, depending on the needs of the spacecraft mission. Also, the antennas do not necessarily need to be attached to the spacecraft body with gimbal arms, but other attachment devices or configuration can be used. For example, as illustrated in FIG. 1, spacecraft may have some antennas attached via gimbal arms and others rigidly attached to the spacecraft body. Thus, the present invention is not limited to the embodiments shown in FIGS. 1 and 2.

Figure 3:
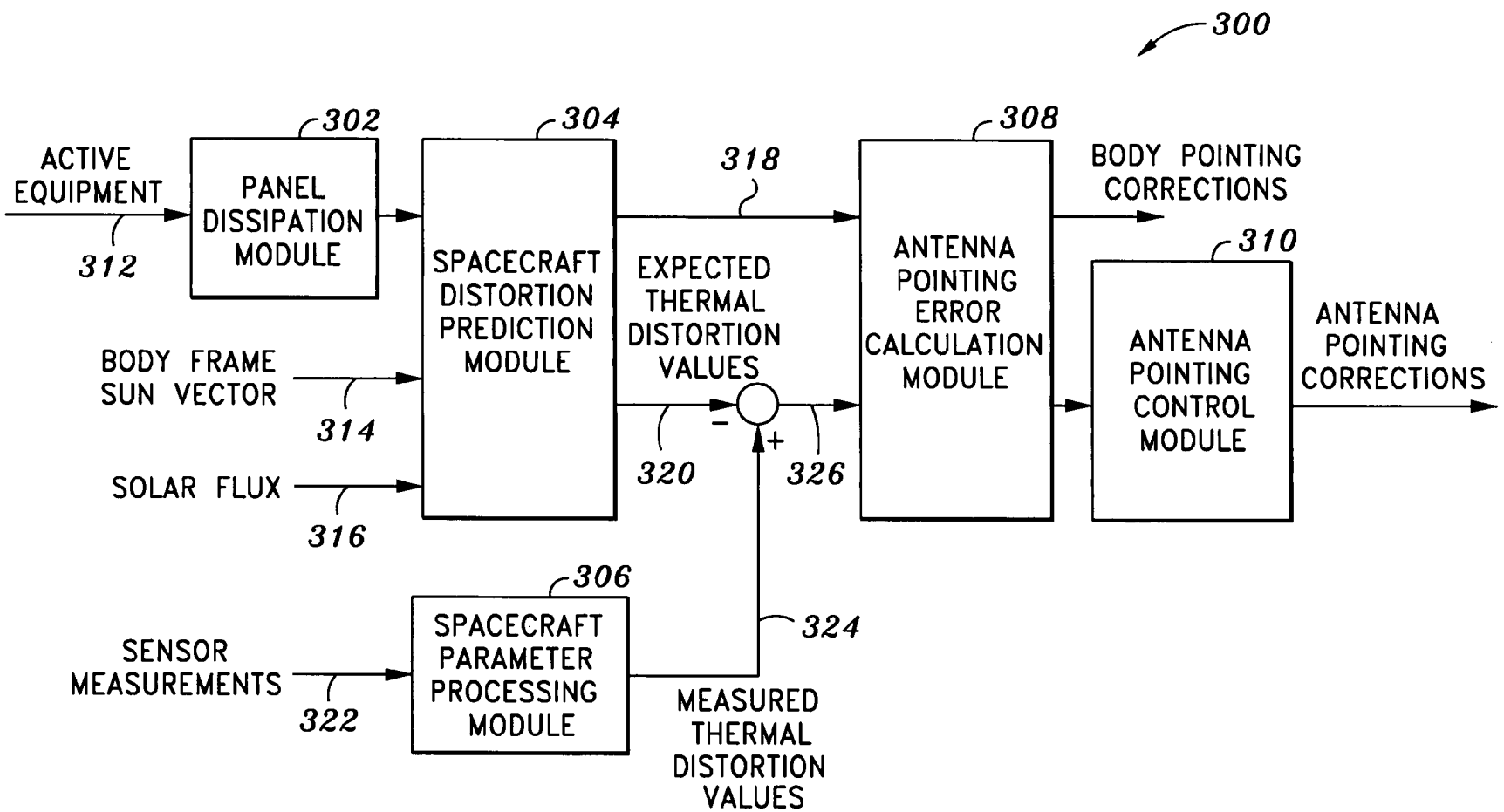
FIG. 3 is a block diagram showing one embodiment of a system in accordance with the present invention.

Referring now to FIG. 3, one embodiment of a thermal distortion pointing correction system 300 in accordance with the present invention is shown. In accordance with the illustrated embodiment, system 300 comprises panel dissipation module 302, a spacecraft distortion prediction module 304, a spacecraft parameter processing module 306, an antenna pointing error calculation module 308, and an antenna pointing control module 310.

In accordance with one embodiment of the invention, panel dissipation module 302 computes the power dissipated on the north, south, and earth panels of the spacecraft based on the number of payload transponder channels that are in use and the on/off status of other on-board equipment (input 312). As one skilled in the art will appreciate, panel dissipation module 302 includes a dissipation model that is used for the dissipation calculations.

Spacecraft distortion module 304 receives the panel dissipations from module 302, as well as the sun vector in the spacecraft body frame 314, and solar flux information 316 and computes predicted or expected antenna thermal distortion pointing errors 318 and predicted or expected thermal distortion parameter values 320 for various positions on the spacecraft. In one embodiment, the expected thermal distortion parameter values 320 are the expected or predicted measurements or values that are related to overall distortions of the structure that effect antenna pointing. The values may include temperature, strain, or other values that are indicative of antenna thermal distortion pointing errors. For example, a temperature difference between the spacecraft east panel and the spacecraft west panel may be indicative of spacecraft bending that affects antenna pitch (z-axis) pointing. A temperature difference between the spacecraft north and south panels may be indicative of spacecraft bending that affects antenna roll (y-axis) pointing.

Spacecraft distortion prediction module 304 includes a distortion prediction model that is used to calculate the expected antenna thermal distortion pointing errors and the expected thermal distortion parameter values. In one embodiment, the prediction model computes the expected antenna thermal distortion pointing errors 318 as:

$$(\phi_i,\theta_i)=f(P,s_b,F_s) \tag{1}$$

where $\phi_i$ and $\theta_i$ are the expected roll and pitch thermal distortion pointing errors for the $i^{th}$ antenna RF boresight vector (i=1, L) referenced to the earth sensor (ESA) coordinate frame; P is the vector of panel dissipations; $S_b$ is the sun vector in the spacecraft body frame; and $F_s$ is the solar flux. In accordance with this particular example, the ESA coordinate frame (the attitude determination reference frame for the spacecraft) is nominally aligned with the spacecraft body frame and located at the ESA. Each antenna boresight vector has an undistorted orientation in this frame, and the expected roll and pitch thermal distortion poiting errors $\phi_i$ and $\theta_i$ are computed as a function of how the orientation of the boresight vectors are expected to change due to thermal distortion. Also, because the angles between the boresight vectors and the spacecraft yaw axis typically are small, the yaw distortions effects are negligible.

As mentioned above, the expected thermal distortion parameter values 320 are the expected temperature or strain values or quantities that are related to overall distortions of the structure that effect antenna pointing. In one embodiment, these expected temperatures or strains can be computed as:

$$\hat{T}_j=g_{T_j}(P,s_b,F_s),\ \hat{S}_k=g_{S_k}(P,s_b,F_s \tag{2}$$

where $\hat{T}_j$ is the expected temperature value at the location of the $j^{th}$ temperature sensor (j=1, M), and $\hat{S}_k$ is the expected strain value at the location of the $k^{th}$ strain gage (k=1, N). As mentioned above, strain measurements, temperature measurements, a combination of strain measurements and temperature measurements, or other suitable measurements can be calculated and used. Also, many options exist for the mathematical form of the functions f, $g_T$, $g_s$ in Equations (1) and (2). For example, predictions can be generated using detailed modeling tools, and then the resulting data can be used to determine the coefficients of a simpler "on-board" model. The raw antenna pointing data can be computed using tools, such as MSC.NASTRAN from MSC. Software Corporation based on the expected temperature profile generated using thermal modeling tools, such as SINDA/G from Network Analysis, Inc. Those skilled in the art are familiar with the tools and techniques necessary to generate temperature and thermal distortion predictions and the resulting antenna pointing errors, as well as determine the functional form and parameters of suitable on-board models. Thus, the present invention is not limited to any particular modeling tool or modeling formulation.

As mentioned above, one embodiment of the present invention uses measurements from on-board sensors (e.g., strain gages and/or temperature sensors) to sense local parameter values related to spacecraft structure distortions, and then the antenna pointing error prediction and correction system 300 uses the differences between measured thermal distortion parameter values (i.e., measured using the strain gages and/or temperature sensors) and the predicted or expected thermal distortion parameter values calculated using spacecraft distortion prediction module 304 to update the antenna pointing error estimates. In accordance with this aspect of the present invention, the sensors are configured to measure spacecraft parameters that are used to determine spacecraft distortions.

As illustrated in FIG. 2, the strain and/or temperature sensors 210 can be positioned on the spacecraft structure at locations that experience the largest changes in the local distortion environment and comprise the most sensitive indicators of antenna pointing errors. Generally, the stain and/or temperature sensors would not be located where there is minimal change in the local distortion or temperature. Suitable locations for the sensors can be identified from analysis of the structure strains, temperature profiles, and antenna pointing errors. The present invention is not limited to the sensor locations shown in FIG. 2.

Referring again to FIG. 3, the sensor measurements 322 are input into spacecraft parameter processing module 306, which calculates measured thermal distortion parameter values 324 at given time steps for which pointing corrections are to be determined. In accordance with one embodiment of the present invention, strain gage sensor measurements are denoted $S^m$ and temperature sensor measurements would be denoted $T^m$. For simplicity, the following steps are described for a system using strain gage measurements only. One skilled in the art will appreciate, however, that similar steps would be performed for a system using temperature measurements or a combination of strain gage and temperature measurements.

In accordance with one embodiment of the present invention, spacecraft parameter processing module 306 is configured to receive sensor measurements (in this example strain gage measurements) 322 and correct them for known measurement biases and apply the proper scale factors or calibration coefficients to convert the raw strain gage outputs to measured thermal distortion parameter values $\overline{S}^m$ 324 in engineering units. Using the measured thermal distortion parameter values $\overline{S}^m$ 324 and the expected thermal distortion parameter values $\hat{S}$ 320, residual thermal distortion parameter values $\overline{S}^r$ 326 can be computed according to the formula:

$$\begin{bmatrix} S_1^r \\ \vdots \\ S_N^r \end{bmatrix} = \begin{bmatrix} S_1^m \\ \vdots \\ S_N^m \end{bmatrix} - \begin{bmatrix} \hat{S}_1 \\ \vdots \\ \hat{S}_N \end{bmatrix} \ or\ \overline{S}^r = \overline{S}^m - \hat{S} \tag{3}$$

The residual thermal distortion parameter values 326 are input into antenna pointing error calculation module 308, which updates the expected antenna thermal distortion pointing errors 318 based on the residual thermal distortion parameter values 326. To update the expected antenna thermal distortion pointing errors 318, thermal distortion pointing error corrections first are calculated, for example, using the following expressions:

$$\Delta\phi = M_\phi \tilde{\delta}^{\prime},\ \Delta\theta = M_\theta \tilde{\delta}^{\prime} \tag{4}$$

where $\Delta\phi$ and $\Delta\theta$ are the L×1 vectors of roll and pitch antenna thermal distortion pointing error corrections, and $M_\phi$ and $M_\theta$ are the L×N roll and pitch sensitivity matrices that relate small changes in the measured thermal distortion parameter values 324 to changes in the antenna pointing errors.

In one embodiment, the sensitivity matrices are computed on the ground using a thermal distortion model, for example, the thermal distortion model created using MSC.NASTRAN or other suitable modeling software, and then uploaded to antenna pointing error calculation module 308. Alternatively, the sensitivity matrices can be computed by antenna pointing error calculation module 308 using similar modeling software. In accordance with these embodiments, a representative set of strains at the strain measurement locations (i.e., nodes) first is determined. The set of strains represents average operational strain values for the nodes. Next, a set of pointing errors for all the antennas is computed for this set of strains. Then the strain at each node independently is varied by a small amount, and the change in the pointing errors is computed. Each term in the sensitivity matrix is computed as the change in pointing divided by the change in the strain. The sensitivity matrices computed in this manner are stored in the spacecraft on-board flight processor for use in the computation of Equation (4).

Using the computed thermal distortion pointing error corrections $\Delta\phi$ and $\Delta\theta$, the expected antenna thermal distortion pointing errors 318 are updated as:

$$\hat{\phi} = \bar{\phi} + K_\phi \Delta\phi,\ \hat{\theta} = \bar{\theta} + K_\theta \Delta\theta \tag{5}$$

where $\bar{\phi}$ and $\bar{\theta}$ are the L×1 vectors of roll and pitch antenna thermal distortion pointing errors and $K_\phi$ and $K_\theta$ are update gains. The update gains typically are set to one, which provides full weighting of the strain measurements. Alternatively, the gains may be set to less than one to reduce the weighting of the measurements and provide greater weighting to the predictions. As previously mentioned, this same process can be performed using temperature measurements instead of strain gage measurements. In addition, a combination of strain gage measurements and temperature measurements can be used. Also, in one embodiment, the processing steps of system 300 can be carried out repetitively at a fixed sampling interval T to determine and correct the antenna pointing errors on a fixed interval basis.

The output of antenna pointing error calculation module 308 are antenna pointing error correction commands. These commands are received by antenna pointing control module 310, which controls the pointing of the antennas, for example, by controlling the antenna gimbal arms.

Also, as mentioned above, one or more antennas can be hard-mounted to the spacecraft (non-gimbaled), such as the earth-deck antenna 108 in FIG. 1. Thus, in order to control the pointing of these antennas, a spacecraft attitude control system determines roll and pitch spacecraft body commands that move the spacecraft to minimize the pointing error of these antennas. For these antennas, the body pointing commands $\phi_b$ and $\theta_b$ are minus the average of the antenna roll and pitch pointing errors (Note: if the pointing requirements are different for the various antennas, then a weighted average can be used). These body commands are input to the spacecraft guidance, navigation and control system, which causes the spacecraft body to be offset pointed relative to the nominal target coordinate frame by the body pointing command angles $\phi_b$ and $\theta_b$.

As one skilled in the art will appreciate, antenna pointing of the fixed antenna is controlled by altering the attitude of the spacecraft. The change in spacecraft attitude probably will affect the antenna pointing error correction commands for the gimbaled antennas. Thus, based on the attitude body commands, and using the result from Equation (5) above, the antenna pointing control module 310 computes the residual roll and pitch pointing errors $\phi_e$, and $\theta_e$ for each gimbaled antenna as:

$$\phi_e \hat{\phi} + \phi_b,\ \theta_e = \hat{\theta} + \theta_b \tag{6}$$

The commanded gimbal angles for each gimbaled antenna that correct the thermal distortion pointing error are then computed using the following expression:

$$\begin{bmatrix} \phi_g \\ \theta_g \end{bmatrix} = \begin{bmatrix} \phi_0 \\ \theta_0 \end{bmatrix} - K_b T_g \begin{bmatrix} \phi_e \\ \theta_e \end{bmatrix} \tag{7}$$

where $T_g$ is the 2×2 matrix for each antenna that transforms from body coordinates to gimbal coordinates, $\phi_o$ and $\theta_o$ are the nominal commanded gimbal angles in the absence of distortion pointing corrections, and $K_b$ is a beam pointing geometric factor. For an antenna with a fixed-feed and a gimbaled reflector (e.g., the east and west antennas shown in FIG. 1), the beam pointing geometric factor $K_b$ is 0.5, and for an antenna where all elements of the antenna system are gimbaled the geometric factor $K_b$ is one. The antenna gimbal orientations are made to track the commanded gimbal angles by commanding a number of gimbal drive steps at each sampling interval. The number of gimbal steps commanded may be computed by dividing the change in angle from the previous time step by the gimbal angular step size.

By performing the method of the present invention, thermal distortion pointing errors can be reduced significantly, and ideally, eliminated. Curve 404 in FIG. 4 illustrates how thermal distortion pointing errors are reduced using the present invention compared to the pointing errors 402 that occur without it.

In conclusion, the present invention provides novel systems, methods and arrangements for correcting thermal distortion pointing errors. While detailed descriptions of one or more embodiments of the invention have been given above, various alternatives, modifications, and equivalents will be apparent to those skilled in the art without varying from the spirit of the invention. For example, while system 300 is illustrated as having separate processing modules, one skilled in the art will appreciate that these modules may be separate or they may be configured as one or more processing systems. Further, system 300 may be configured as one or more processing components or modules of the spacecraft's guidance, navigation and control system. Therefore, the above description should not be taken as limiting the scope of the invention, which is defined by the appended claims.

What is claimed is:

1. A method for correcting spacecraft thermal distortion antenna pointing errors, comprising:

measuring spacecraft thermal distortion parameter values using one or more spacecraft sensors, the spacecraft thermal distortion parameter values being related to spacecraft thermal distortions;

calculating estimated antenna distortion pointing errors caused by the spacecraft thermal distortions using the measured spacecraft parameter values;

adjusting the antenna pointing to correct for the estimated antenna pointing errors;

computing expected spacecraft thermal distortion parameter values;

computing expected antenna thermal distortion pointing errors; and using the expected spacecraft thermal distortion parameter values, the measured spacecraft thermal distortion parameter values, and the expected antenna thermal distortion pointing errors to calculate the estimated antenna thermal distortion pointing errors.

2. The method as recited in claim 1, wherein the one or more spacecraft sensors comprise one or more strain gages, and the measured spacecraft parameter values comprise spacecraft strain values.

3. The method as recited in claim 1, wherein the one or more spacecraft sensors comprise one or more temperatures sensors, and the measured spacecraft parameter values comprise spacecraft temperature values.

4. The method as recited in claim 1, wherein adjusting the antenna pointing comprises adjusting the antenna gimbal arm to which the antenna is attached.

5. The method as recited in claim 1, wherein adjusting the antenna pointing comprises adjusting the attitude of the spacecraft.

6. The method as recited in claim 1, wherein the method is performed repetitively at a sampling interval.

7. The method as recited in claim 1, wherein the expected spacecraft thermal distortion parameter values are generated using one or more input parameters selected from the group consisting of sun vector information, solar flux information, and spacecraft panel dissipation information.

8. The method as recited in claim 1, wherein the expected antenna thermal distortion pointing errors are generated using one or more input parameters selected from the group consisting of sun vector information, solar flux information, and spacecraft panel dissipation information.

9. A method for correcting spacecraft thermal distortion antenna pointing errors, comprising:

computing expected spacecraft thermal distortion parameter values;

computing expected antenna thermal distortion pointing errors;

measuring spacecraft thermal distortion parameter values using one or more spacecraft sensors, the spacecraft thermal distortion parameter values being related to spacecraft thermal distortions;

calculating antenna thermal distortion pointing error correction values using the expected spacecraft thermal distortion parameter values and the measured spacecraft thermal distortion parameter values;

using the expected antenna thermal distortion pointing errors and the antenna thermal distortion pointing error correction values to generate final antenna thermal distortion pointing error estimates; and adjusting the antenna pointing to correct for the final antenna pointing error estimates.

10. The method as recited in claim 9, wherein the one or more spacecraft sensors comprise one or more strain gages, and the measured spacecraft thermal distortion values comprise spacecraft strain values.

11. The method as recited in claim 9, wherein the one or more spacecraft sensors comprise one or more temperatures sensors, and the measured spacecraft thermal distortion values comprise spacecraft temperature values.

12. The method as recited in claim 9, wherein adjusting the antenna pointing comprises adjusting an antenna gimbal arm to which the antenna is attached.

13. The method as recited in claim 9, wherein adjusting the antenna pointing comprises adjusting the attitude of the spacecraft.

14. The method as recited in claim 9, wherein the method is performed repetitively at a sampling interval.

15. The method as recited in claim 9, wherein the expected antenna thermal distortion pointing errors are generated using one or more input parameters selected from the group consisting of sun vector information, solar flux information, and spacecraft panel dissipation information.

16. The method as recited in claim 9, wherein the expected spacecraft thermal distortion parameter values are generated using one or more input parameters selected from the group consisting of sun vector information, solar flux information, and spacecraft panel dissipation information.

17. The method as recited in claim 9, wherein the final antenna pointing error estimates are a function of the expected antenna thermal distortion pointing errors and the antenna thermal distortion pointing error correction values according to the equation:

$$\hat{\phi}=\bar{\phi}+K_{\phi}\Delta\phi,\ \hat{\theta}=\bar{\theta}+K_{\theta}\Delta\theta.$$

18. A system for correcting spacecraft thermal distortion antenna pointing errors, comprising:

one or more spacecraft sensors located at positions on a spacecraft and adapted to measure spacecraft parameters at the positions;

a spacecraft distortion prediction module adapted to generate expected spacecraft thermal distortion parameter values and to generate expected antenna thermal distortion pointing errors;

a spacecraft parameter processing module adapted to generate measured spacecraft thermal distortion parameter values from the measured spacecraft parameters;

an antenna pointing error calculation module adapted to calculate antenna pointing error corrected commands using the using the expected spacecraft thermal distortion parameter values, the measured spacecraft thermal distortion parameter values and the expected antenna thermal distortion pointing errors;

an antenna pointing control module adapted to receive the antenna pointing correction commands and control the adjustment of the antenna pointing using the correction commands.

19. The system as recited in claim 18, wherein the spacecraft distortion prediction module, the spacecraft parameter processing module, the antenna pointing error calculation module, and the antenna pointing control are configured as one or more processing modules.

20. The system as recited in claim 18, wherein the one or more sensors are selected from the group consisting of strain gage sensors, temperature sensors, or a combination of strain gage sensors and temperature sensors.

21. The system as recited in claim 18, wherein the antenna pointing error calculation module calculates the antenna pointing error correction command by:

calculating antenna thermal distortion pointing error correction values using the expected spacecraft thermal distortion parameter values and the measured spacecraft thermal distortion parameter values;

calculating final antenna thermal distortion pointing error estimates using the expected antenna thermal distortion pointing errors and the antenna thermal distortion pointing error correction values; and generating the antenna pointing error correction commands using the final antenna thermal distortion pointing error estimates.

22. The system as recited in claim 18, wherein the spacecraft distortion prediction module uses one or more input parameters selected from the group consisting of sun vector information, solar flux information, and spacecraft panel dissipation information to generate the expected spacecraft thermal distortion parameter values and to generate the expected antenna thermal distortion pointing errors.

23. The system as recited in claim 18, wherein the antenna is attached to a gimbal arm, and wherein the antenna pointing control module controls the antenna pointing by controlling the gimbal arm.

24. The system as recited in claim 18, wherein the antenna is attached to the spacecraft body, and wherein the system further comprises a spacecraft attitude control system which changes the attitude of the spacecraft in order to change the antenna pointing.

25. The system as recited in claim 18, wherein the antenna pointing error calculation module calculates the final antenna thermal distortion pointing error estimates as a function of the expected antenna thermal distortion pointing errors and the antenna thermal distortion pointing error correction values according to the formula:

$$\hat{\phi}=\bar{\phi}+K_{\phi}\Delta\phi,\ \hat{\theta}=\bar{\theta}+K_{\theta}\Delta\theta.$$

* * * * *